US006713950B2

(12) United States Patent
Soules et al.

(10) Patent No.: US 6,713,950 B2
(45) Date of Patent: Mar. 30, 2004

(54) LOW VOLATILITY SLURRY FOR EMISSION MIX POWDER

(75) Inventors: Thomas F. Soules, Richmond Heights, OH (US); Gábor Sajó , Budapest IV (HU)

(73) Assignee: General Electric Company, Schenectady, NY (US)

( * ) Notice: Subject to any disclaimer, the term of this patent is extended or adjusted under 35 U.S.C. 154(b) by 47 days.

(21) Appl. No.: 09/934,722

(22) Filed: Aug. 22, 2001

(65) Prior Publication Data

US 2003/0076042 A1 Apr. 24, 2003

(51) Int. Cl.[7] ..... H01J 1/14
(52) U.S. Cl. ..... 313/346 R; 313/630
(58) Field of Search ..... 313/491, 633, 313/311, 346 R, 355, 630; 445/51

(56) References Cited

U.S. PATENT DOCUMENTS

| | | | | |
|---|---|---|---|---|
| 1,812,103 A | | 6/1931 | MacRae | |
| 1,974,608 A | | 9/1934 | Giard | |
| 2,134,415 A | | 10/1938 | Patai | |
| 2,385,313 A | | 9/1945 | Thurber et al. | |
| 2,673,387 A | | 3/1954 | Forker | |
| 3,505,553 A | | 4/1970 | Piree | |
| 3,597,271 A | | 8/1971 | Cawley et al. | |
| 4,158,153 A | * | 6/1979 | Eckberg | 313/491 |
| 4,251,569 A | | 2/1981 | Mager et al. | |
| 4,461,970 A | | 7/1984 | Anderson | |
| 4,523,125 A | | 6/1985 | Anderson | |
| 4,620,128 A | | 10/1986 | Luthra | |
| 4,836,816 A | | 6/1989 | Bouchard et al. | |
| 5,204,139 A | | 4/1993 | Choi | |
| 5,256,095 A | | 10/1993 | Takegawa et al. | |
| 5,432,403 A | * | 7/1995 | Shaffer | 313/619 |
| 5,550,431 A | | 8/1996 | Duggan et al. | |
| 5,614,784 A | | 3/1997 | Harzig et al. | |
| 6,157,132 A | | 12/2000 | Strok et al. | |

FOREIGN PATENT DOCUMENTS

| | | |
|---|---|---|
| SU | 858141 | 8/1981 |

* cited by examiner

*Primary Examiner*—Ashok Patel
*Assistant Examiner*—Glenn Zimmerman
(74) *Attorney, Agent, or Firm*—Pearne & Gordon LLP

(57) ABSTRACT

An emission mix slurry for coating fluorescent lamp electrodes is provided having a suspension medium of polyethylene glycol 200, and a mixture of calcium-, strontium-, and barium carbonate powder as suspended solids. In another embodiment, the suspension medium is primarily water. The slurry is formulated such that upon activation, the carbonates are oxidized to their corresponding oxides to form the emission mix oxide coating while the polyethylene glycol suspension medium is cleanly oxidized evolving substantially only $CO_2$ and $H_2O$ vapor. A method for preparing the emission mix slurry is also provided.

23 Claims, 2 Drawing Sheets

LOW VOLATILITY SLURRY FOR EMISSION MIX POWDER

BACKGROUND OF THE INVENTION

1. Field of the Invention

This invention relates to a fluorescent lamp having improved life and efficiency, and more particularly to a fluorescent lamp having electrodes coated with a low volatility emission mix slurry.

2. Description of Related Art

Coating the electrodes in a fluorescent lamp with an emission mix material is well known. Emission mix is typically applied to the electrodes as a slurry comprising an inorganic mixture of barium, strontium and calcium carbonates which is subsequently decomposed during an activation step to the active emission mix oxide material. The most common reason for failure of a fluorescent lamp is the breakdown or depletion of the emission mix oxide on the lamp electrodes.

Current emission mix slurries are suspensions containing about 60 wt. % suspended carbonate solids in a low molecular weight acetate solvent suspension medium including nitrocellulose as a thickener or binder. This slurry is similar to lacquers used in painting applications for centuries, and commonly used in paint lacquer since World War I.

There are several important disadvantages of this type of suspension for emission mix applications. First, commonly used acetate solvents such as isopropyl acetate, butyl acetate, etc., are quite volatile, having high evaporation rates. While desirable for fast drying of lacquers, high volatility presents a problem when coating electrodes. One problem is that the specific gravity of acetate suspensions continually increases during production coating runs due to acetate evaporation. The specific gravity must be readjusted, typically every couple of hours, by adding more binder or solvent to prevent the emission mix coating weight from going out-of-spec. Because the emission mix coating weight is proportional to lamp life, the result is production of fluorescent lamps whose service lives vary as much as 10% from the same batch of emission mix slurry. Consistent lamp life is not possible without continuous readjustment of the specific gravity of the emission mix slurry. In practice even periodic readjustment is not always practiced at lamp plants, so variability in emission mix coating weight and lamp life can be even greater.

Second, acetate-based slurries have low viscosity causing suspended solids to settle very quickly. The slurry must be continuously stirred during production to keep the solids in suspension, which further accelerates acetate evaporation. Otherwise, even assuming uniform overall coating weight, subsequently coated electrodes will exhibit nonuniform deposition of emission mix oxides. This leads to nonuniform electrode activation and unpredictable performance.

A further disadvantage of low viscosity is that the coating quickly wicks to the ends of the electrode upon coating, often plugging the ends while leaving the center of the cathode practically uncoated. This highly nonuniform coating prevents the cathode from being uniformly activated; i.e. resulting in overactivation in the center region of the cathode and underactivation in the heavily coated ends of the cathode.

In addition, the high volatility, combustibility and objectionable odor of acetate/nitrocellulose suspensions present additional safety and OSHA concerns.

There is a need in the art for an emission mix slurry having a solvent/binder system that substantially overcomes the above shortcomings, providing a uniform coating of emission mix slurry throughout a production run. Preferably, such a solvent/binder system will not present significant fire or safety hazards.

SUMMARY OF THE INVENTION

A mercury vapor discharge lamp is provided having a light-transmissive glass envelope, an electrode disposed within the glass envelope to provide a discharge, a phosphor layer coated adjacent the inner surface of the envelope, a fill gas of mercury and an inert gas sealed inside the envelope, and a rare earth oxide layer coated over the surface of the electrode. The oxide layer is formed from an emission mix slurry comprising 20–50 wt. % suspension medium and 50–80 wt. % carbonate powder as suspended solids. The suspension medium is selected from the group consisting of (a) organic materials having a vapor pressure of less than 0.1 mm Hg at 20° C., and (b) water.

An emission mix slurry is also provided for coating onto a fluorescent lamp electrode. The slurry comprises 20–50 wt. % suspension medium and 50–80 wt. % carbonate powder as suspended solids. The suspension medium is selected from the group consisting of (a) organic materials having a vapor pressure of less than 0.1 mm Hg at 20° C., and (b) water.

A method of making an emission mix slurry for coating onto a fluorescent lamp is also provided. The method has the steps of: a) adding zirconia powder to a suspension medium at a rate of less than 1 gram per liter of suspension medium per minute under conditions of vigorous mixing to form a mixture, wherein the suspension medium is polyethylene glycol 200, polyethylene glycol 300, glycerin, ethylene glycol monomer, or a mixture of any thereof; b) vigorously mixing the mixture to uniformly disperse the zirconia powder throughout the suspension medium; c) adding the mixture to carbonate powder under conditions of vigorous mixing to form a slurry, wherein the carbonate powder comprises calcium carbonate, strontium carbonate and barium carbonate; d) vigorously mixing the slurry until the carbonate powder is substantially completely wetted; and e) rolling the slurry on rollers to promote uniform dispersion of the carbonate powder in the slurry, wherein the slurry comprises 20–50 wt. % suspension medium, 50–80 wt. % carbonate powder, and 0.001–10 wt. % zirconia powder.

DETAILED DESCRIPTION OF THE PREFERRED EMBODIMENTS OF THE INVENTION

In the description that follows, when a preferred range, such as 5 to 25 (or 5–25), is given, this means preferably at least 5, and separately and independently, preferably not more than 25. When a range is given in terms of a weight percent (wt. %) for a single component of a mixture, this means that the single component is present by weight in the mixture in the stated proportion relative to the total weight of the mixture. Unless clearly indicated otherwise, all percents of components expressed herein are weight percents.

Figure 1:
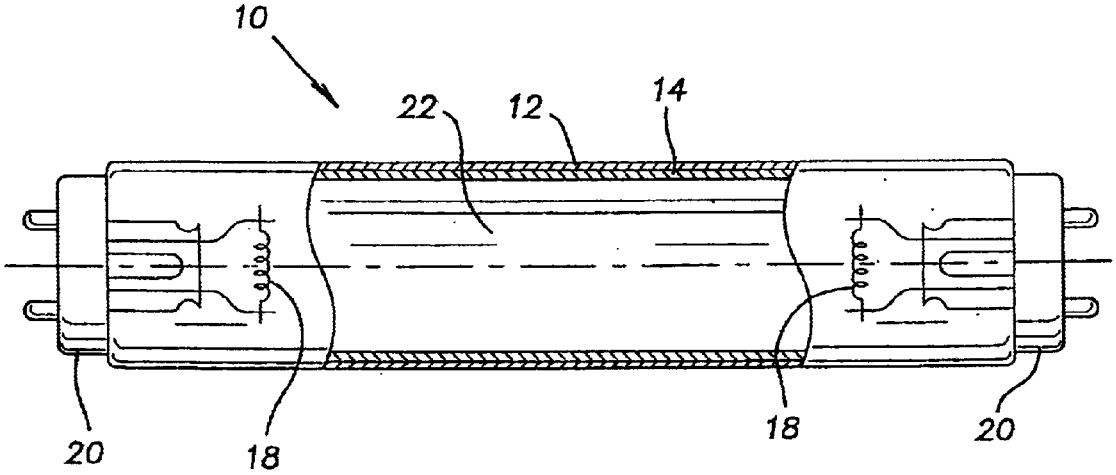
FIG. 1 shows a side view, partially in section, of a representative mercury vapor discharge fluorescent lamp having electrodes coated with the invented emission mix slurry.

Referring to FIG. 1, lamp 10 has a light-transmissive glass tube or envelope 12 that is hermetically sealed by bases 20 attached at both ends. A pair of spaced electrodes 18 are respectively mounted on the bases 20. A phosphor layer 14 is coated on the inner surface of glass envelope 12. A discharge-sustaining fill gas 22 of mercury and an inert gas is sealed inside the glass tube. The inert gas is typically argon or a mixture of argon and krypton.

Figure 2:
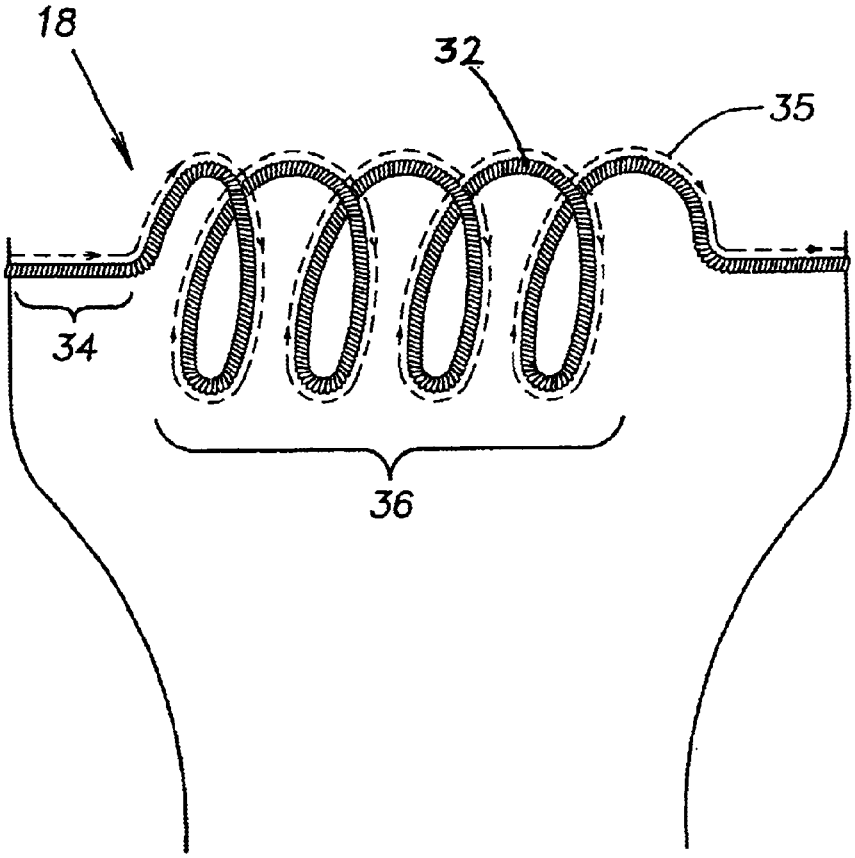
FIG. 2 shows a side view of a lamp electrode of the lamp of FIG. 1.

FIG. 2 shows an electrode 18 from lamp 10. The electrode has a primary or current carrying wire 32 that is tightly wound or coiled in a spring-like configuration, such that the current carrying wire 32 resembles an expansion spring. The adjacent turnings that make up the secondary coiling are preferably in intimate contact with one another. This tight coiling of the current carrying wire is referred to as the secondary coiling 34. This secondary coiling 34 has a secondary length 35 which is the overall length of the secondarily coiled wire in the secondary coiling, and not the total length of the current carrying wire 32. It will be understood from FIG. 2 that the secondary length 35 is shorter than the total length of current carrying wire 32. Optionally, electrode 18 may have a tertiary coiling 36. As shown in FIG. 2, a tertiary coiling 36 is formed by winding the secondary coiling into a loose spring configuration with adjacent turnings of the tertiary coiling 36 spaced from one another. Regardless of whether a tertiary coiling 36 is present, secondary length 35 is measured along the entire length of the secondary coiling 34, including through the individual turnings of a tertiary coiling 36.

According to a first preferred embodiment of the invention, a preferred emission mix slurry suspension has the components and component concentrations as described below in table 1. In table 1, it is not required or necessary that all or any of the concentrations or ranges for all of the components come from the same column. Note that in table 1 all values are weight percents.

TABLE 1

Preferred formulation for organic emission mix slurry

| Component | Preferred wt. % | Less Preferred wt. % | Less Preferred wt. % |
|---|---|---|---|
| Suspension medium | 36.45 | 30–40 | 20–50 |
| Carbonate powder | 62.3 | 60–70 | 50–80 |
| Zirconia powder | 1.2 | 0.5–5 | 0–10 |
| Wetting agent | 0.05 | 0.02–0.5 | 0–1 |

The suspension medium is a low volatility liquid which is preferably easily decomposed or oxidized to carbon dioxide and water during activation. The term "low volatility" means that the suspension medium has a vapor pressure of less than 0.1, preferably less than 0.01, mm Hg at 20° C.

In the first preferred embodiment, the suspension medium is organic, preferably a mixture of low molecular weight polyethylene glycols (MW=180 to 400 g/mol) having the general formula $H(OCH_2CH_2)_nOH$. Most preferably, the suspension medium is polyethylene glycol 200 or PEG 200 (preferably E200 from Dow Chemical), with an average value of n=4, and an average molecular weight of 190–210 g/mol. Less preferably, the suspension medium is glycerin, less preferably polyethylene glycol 300 or PEG 300 (E300 from Dow Chemical) with an average molecular weight of about 300 g/mol, less preferably ethylene glycol monomer. PEG 200 is the most preferred suspension medium because it has the most desirable combination of characteristics; i.e. its viscosity is well suited to retaining carbonate powder solids in suspension, it is substantially nonflammable and incombustible, and it has low volatility (low vapor pressure) and low toxicity. (The oral LD50 in rats for PEG 200 is 28 g/kg compared with about 3000–11000 mg/kg for typical acetate solvents). Both glycerin and PEG 300 have greater viscosity than PEG 200, making them more energy and cost intensive to handle and to stir, as well as making coating of electrodes more difficult.

In a second preferred embodiment, the suspension medium is water-based, comprising at least 90, preferably 95, preferably 98, wt. % deionized water, and containing a small amount of a dispersant, such as Dispex A40 (an aqueous acrylic polymer solution from Allied Colloid Limited). The medium is then thickened to achieve a desired viscosity using a high molecular weight polyethylene glycol (MW=at least 1000 g/mol, preferably 2000–5000 g/mol). A preferred emission mix slurry suspension according to the second preferred embodiment has the components and component concentrations as described below in table 2. In table 2, it is not required or necessary that all or any of the concentrations or ranges for all of the components come from the same column. Note that in table 2, all values are weight percents.

TABLE 2

Preferred formulation for water-based emission mix slurry

| Component | Preferred wt. % | Less Preferred wt. % | Less Preferred wt. % |
|---|---|---|---|
| Deionized Water | 31 | 25–40 | 20–50 |
| Carbonate powder | 69 | 60–75 | 50–80 |
| Defoamer | 0.03 | 0.02–0.5 | 0–1 |
| Dispersant | 0.36 | 0.2–0.5 | 0.1–1 |
| Thickener | 0.35 | 0.2–0.5 | 0.1–1 |

The preferred thickener in table 2 is Polyox WSRN 3000, a commercial polyethylene glycol product having a mean molecular weight of about 3000 g/mol, and is added to yield a water-based suspension medium having a viscosity of at least 10 cP. Also in table 2, the preferred dispersant is Dispex A-40, preferably with a small amount (0.01 wt. % of the total slurry) of Genapol PF-10, a block copolymer mixture of 90 wt. % polyethylene glycol and 10 wt. % ethylene glycol available from Clariant Corporation. The preferred defoamer is BYK-033 from BYK-Chemie. BYK-033 is a mixture of hydrophobic components in paraffin-based mineral oil.

Less preferably, some other known organic liquid can be used as the suspension medium so long as it has sufficient oxygen content to be substantially oxidized upon activation once coated on an electrode. For example, PEG 200 has a very high oxygen content and is readily oxidized to $CO_2$ and $H_2O$ upon activation after coating. A suitable suspension medium for the invented slurry preferably does not require the addition of $O_2$ to be cleanly oxidized upon activation, is cleanly oxidized to $CO_2$ and $H_2O$ upon activation of the slurry by application of an electric current across the electrode, and has a mean viscosity of 10–10000 cP, preferably 10–1000 cP. The term "cleanly oxidized" means that upon activation, the suspension medium is substantially completely oxidized to $CO_2$ and $H_2O$, leaving no residue, or only negligible residue, on the electrode. (It will be understood that when water is used as the suspension medium, the oxygen content of the water is immaterial because water is already fully oxidized and will not undergo further oxidation upon activation. Rather, the liquid water suspension medium will simply vaporize during activation and be drawn out of the lamp as water vapor under vacuum as will be described).

The carbonate powder is most preferably a heterogeneous mixture of calcium carbonate, barium carbonate and strontium carbonate powders. The ratio of calcium carbonate-:barium carbonate:strontium carbonate in a preferred slurry is preferably about 50:40:10, less preferably about 50:30:20, less preferably +20, +40 or +50 percent of any of these numbers, less preferably some other ratio, by weight. Optionally, and preferably when a water-based suspension medium is used, the carbonate powder also includes zirconium carbonate, the preferred mass ratio being 59:22.3:15.1:3.6, Ba:Sr:Ca:Zr. Regardless of the ratio of carbonates in the carbonate powder, the powder preferably has a substantially uniform composition and a mean particle size in the range of 3–20 $\mu$m.

Optionally and preferably when an organic suspension medium is used, the invented slurry also contains zirconia powder in a quantity effective to help extend lamp life and decrease end discoloration of the lamp. The zirconia powder preferably has a mean particle size of 1–2 $\mu$m, less preferably 0.001–5 $\mu$m.

Optionally, the invented slurry also contains a wetting agent to aid wetting of the electrode by the slurry. The wetting agent can be any wetting agent known in the art that is effective to wet a metal electrode surface with the suspension medium of the invented slurry. Other components known in the chemical processing and compounding arts (such as dispersants, binders, thickeners, etc.) can also be added to the invented slurry to further tune its physical and rheological properties as desired.

The preferred E200-based slurry is preferably made as follows. The zirconia powder is slowly added to the PEG 200 suspension medium (preferably less than 1 gram per liter of suspension medium per minute) under conditions of vigorous mixing, e.g. by a high shear mixer such as a Kady mill. Once the zirconia powder has been uniformly dispersed throughout the suspension medium, the liquid mixture (PEG 200 plus zirconia powder) is slowly added to the carbonate powder, again with vigorous mixing. The wetting agent is added and mixing is continued until the liquid completely wets the carbonate powder to form the slurry. The slurry is then poured into containers and placed on rollers to promote uniform dispersion of the carbonate powder, preferably at least 25–30 minutes. It is important to first disperse the zirconia powder in the suspension medium before adding the mixture to the carbonate powder to ensure that the zirconia is uniformly dispersed in the final emission mix slurry. An E200-based emission mix slurry prepared in this manner has the advantage that it does not require ball milling to disperse the individual components; component dispersion is achieved via high shear mixing as above described.

The preferred water-based slurry is prepared by first delivering the deionized water into a ball mill with milling balls. The milling balls are preferably 9-mm diameter porcelain balls. The mass of milling balls should be approximately twice that of the deionized water and carbonate powder combined. The dispersant is then added, followed by the carbonate powder. The mixture is ball milled until substantially uniformly dispersed, preferably at least 8 hours. After ball milling, the mixture is delivered to an impeller mixer and, with intensive stirring, the thickener and defoamer components are added. The mixture is continuously and vigorously stirred for 30 minutes to provide the finished emission mix slurry suspension which is ready for coating on a lamp electrode.

A slurry according to the first preferred embodiment using an organic suspension medium is substantially nonvolatile, thereby retaining at least 95% (preferably at least 99%) of its initial specific gravity for an extended period of time, preferably at least 2, preferably 4, preferably 8, preferably 16, preferably 24, preferably 36, preferably 48, 72, 96, or 120, hours under ambient atmospheric conditions (i.e. 1 atm and 22° C.). A slurry according to either the first or second preferred embodiment has sufficient viscosity to retain the carbonate powder in suspension for an extended period of time, preferably at least 2, 4, 8, 16, 24, 36, 48, 72, 96, or 120, hours without needing to be continuously or periodically remixed to re-suspend settled solids The carbonate powder is considered to be "in suspension" when at least 90%, preferably at least 95%, most preferably at least 99%, of the total carbonate powder remains suspended in the slurry and has not settled to the bottom of the slurry container.

Once prepared, the invented emission mix slurry is applied to a lamp electrode by known methods to produce an emission mix slurry coating with the powdered carbonates substantially uniformly distributed over the electrode surface. Once coated, the electrode is energized inside a light tube while evacuating the tube, thus oxidizing the carbonates to their corresponding oxides while evolving $CO_2$ and $H_2O$ from the organic suspension medium (preferably PEG 200). (When water is used as the suspension medium, the water simply vaporizes to $H_2O_{(vap)}$). The evolved gases are evacuated from the lamp during the evacuation step leaving a clean, dry emission mix oxide coating on the electrode surface.

The invented slurry preferably results in an oxide coating over the secondary coiling 34 of electrode 18 having a coating weight of 0.2–0.6, more preferably about 0.335, mg/mm of the secondary length 35. The oxide coating is substantially uniformly coated over the secondary coiling 34, which means that the average deviation in coating weight over the secondary length 35 is less than 20% measured in mg/mm.

The invented emission mix slurry has substantially constant viscosity and specific gravity due to the low (or non-) volatility of the suspension medium. In addition, the carbonate solids are uniformly and stably suspended in the suspension medium. The result is that with the invented slurry the emission mix oxide coating is substantially uniform for subsequent electrodes and also over the surface of individual electrodes, resulting in constant and predictable performance from lamp to lamp having electrodes coated with the invented emission mix slurry. The invented slurry is also substantially nontoxic and odorless.

Further aspects of the invention will be understood in conjunction with the following examples.

EXAMPLE 1

Two sets of fifteen T8 lamps were tested, one set having electrodes coated with standard emission mix slurry having an acetate suspension medium, and the other set having electrodes coated with the invented emission mix slurry having an E200 suspension medium. 100-hour lamp data are provided below in table 3. The following data were measured on a standard 60 Hz reference power supply.

TABLE 3

Comparison of standard and invented emission mix slurries

| Lamp | Volts | Amps | Electrode Wattage | Lamp Watts | Lumens | Lumens/ Watt | X | Y |
|---|---|---|---|---|---|---|---|---|
| Standard Emission Mix | 138.2 ± 1.0 | 0.261 ± 0.001 | 1.9 ± 0.1 | 32.7 ± 0.3 | 3012 ± 11 | 92.1 ± 0.9 | 0.4135 ± 0.0003 | 0.3938 ± 0.005 |
| Invented Emission Mix | 137.1 ± 0.9 | 0.26 ± 0.001 | 1.9 ± 0 | 32.2 ± 0.1 | 3012 ± 8 | 93.6 ± 0.5 | 0.4137 ± 0.003 | 0.3938 ± 0.004 |

As seen from table 3, the electrodes coated with the invented slurry performed well compared to the standard slurry, experiencing no discernible discoloration. (X and Y in table 3 represent the red and green chromaticity coordinates respectively of the lamps. They are virtually constant between lamps using the standard and invented slurries). Furthermore, lamps utilizing the invented slurry started immediately upon energizing, and produced virtually the same lumens but with 0.5 fewer watts, resulting in a total gain of lumen efficiency of about 1.5% measured in lumens/watt.

The evaporation rates of the standard and invented slurries were also measured experimentally. An uncovered beaker initially containing 100.4 g of the standard acetate suspension, and a second uncovered beaker initially containing 100.2 g of the invented E200 suspension were placed on separate but equivalent balances next to one another under identical ambient conditions at room temperature. After two days, only 97.2 g of the acetate suspension remained, while 100.4 g of the E200 suspension remained. It is believed that the E200 sample may have absorbed 0.2 g of ambient moisture; clearly it did not suffer any significant evaporation loss. The acetate suspension, on the other hand, lost 3.2 g (about 3.2 wt. %) to evaporation.

EXAMPLE 2

Standard halophosphate fluorescent lamps having electrodes coated with the invented water based emission mix slurry have been burned for some time. Performance data is shown in table 4 for five lamps.

TABLE 4

Test of fluorescent lamps using water based emission mix slurries

| | Burning Time (Hours) | | | | | | | | |
|---|---|---|---|---|---|---|---|---|---|
| | 0 | 100 | 500 | 1000 | 2000 | 5250 | 7500 | 10000 | 28200 |
| | Lumens | | | | | | | | |
| Lamp 1 | 2751 | 2525 | 2314 | 2242 | 2147 | 1969 | 1957 | 1891 | 1643 |
| Lamp 2 | 2729 | 2522 | 2267 | 2198 | 2119 | 1929 | 1900 | 1852 | 1604 |
| Lamp 3 | 2710 | 2505 | 2296 | 2207 | 2133 | 1964 | 1944 | 1887 | 1623 |
| Lamp 4 | 2773 | 2556 | 2357 | 2265 | 2180 | 2030 | 1973 | 1913 | 1644 |
| Lamp 5 | 2736 | 2518 | 2330 | 2248 | 2162 | 1990 | 1969 | 1899 | 1653 |
| Average: | 2740 | 2525 | 2313 | 2232 | 2148 | 1976 | 1949 | 1888 | 1633 |
| Percent of 100-Hr. Lumens | 108% | 100% | 92% | 88% | 85% | 78% | 77% | 75% | 65% |

A surprising result from this test is that only one lamp burned out and it burned out at 31280 hours. These lamps are typically rated at 10000 hrs and normally have mean lifetimes of less than or equal to 20000 hrs. The water based slurry may enhance lamp life by binding the emission mix material to the electrode better.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge lamp comprising a light-transmissive glass envelope, an electrode disposed within said glass envelope to provide a discharge, a phosphor layer coated adjacent an inner surface of said envelope, a fill gas of mercury and an inert gas sealed inside said envelope, and a rare earth oxide layer substantially uniformly disposed over a surface of said electrode, said oxide layer being formed from an emission mix slurry, said slurry comprising 20–50 wt. % suspension medium and 50–80 wt. % carbonate powder as suspended solids, said suspension medium being selected from the group consisting of organic materials having a vapor pressure of less than 0.1 mm Hg at 20° C.

2. A mercury vapor discharge lamp comprising a light-transmissive glass envelope, an electrode disposed within said glass envelope to provide a discharge, a phosphor layer coated adjacent an inner surface of said envelope, a fill gas of mercury and an inert gas sealed inside said envelope, and a rare earth oxide layer substantially uniformly disposed over a surface of said electrode, said oxide layer being formed from an emission mix slurry, said slurry comprising 20–50 wt. % suspension medium and 50–80 wt. % carbonate powder as suspended solids, said suspension medium being selected from the group consisting of (a) organic materials having a vapor pressure of less than 0.1 mm Hg at 20° C., and (b) water, said electrode having a secondary coiling, said secondary coiling having a secondary length, said oxide layer being coated on said secondary coiling and having a coating weight of 0.2–0.6 mg/mm along said secondary length, said coating weight being substantially uniform over said secondary coiling along said secondary length.

3. A lamp according to claim 2, said coating weight being about 0.335 mg/mm.

4. A lamp according to claim 2, said electrode further having a tertiary coiling.

5. An emission mix slurry for coating onto a fluorescent lamp electrode, said slurry comprising 20–50 wt. % suspension medium and 50–80 wt. % carbonate powder as suspended solids, said suspension medium being selected from the group consisting of organic materials having a vapor pressure of less than 0.1 mm Hg at 20° C.

6. A slurry according to claim 5, said suspension medium having a sufficiently high oxygen content such that it is cleanly oxidized to substantially only $CO_2$ and $H_2O_{(vap)}$ upon activation of said slurry via application of an electric current.

7. A slurry according to claim 5, wherein said suspension medium is polyethylene glycol 200.

8. An emission mix slurry for coating onto a fluorescent lamp electrode, said slurry comprising 20–50 wt. % suspension medium and 50–80 wt. % carbonate powder as suspended solids, said suspension medium being deionized water.

9. A slurry according to claim 8, said slurry further comprising at least one additive selected from the group consisting of dispersants, thickeners and binders.

10. A slurry according to claim 5, wherein said suspension medium is selected from the group consisting of polyethylene glycol 300, glycerin and ethylene glycol monomer, and mixtures thereof.

11. A slurry according to claim 5, wherein said carbonate powder comprises a mixture of calcium carbonate, barium carbonate and strontium carbonate.

12. A slurry according to claim 5, said carbonate powder having a mean particle size of 3–20 $\mu$m.

13. An emission mix slurry for coating onto a fluorescent lamp electrode, said slurry comprising 20–50 wt. % suspension medium and 50–80 wt. % carbonate powder as suspended solids, said suspension medium being selected from the group consisting of (a) organic materials having a vapor pressure of less than 0.1 mm Hg at 20° C., and (b) water, said carbonate powder comprising a mixture of calcium carbonate, barium carbonate and strontium carbonate, the ratio of calcium carbonate:barium carbonate:strontium carbonate in said carbonate powder being about 50:40:10 or about 50:30:20 by weight.

14. An emission mix slurry for coating onto a fluorescent lamp electrode, said slurry comprising 20–50 wt. % suspension medium and 50–80 wt. % carbonate powder as suspended solids, said suspension medium being selected from the group consisting of (a) organic materials having a vapor pressure of less than 0.1 mm Hg at 20° C., and (b) water, said carbonate powder comprising barium carbonate, strontium carbonate, calcium carbonate and zirconium carbonate, the ratio of barium carbonate:strontium carbonate:calcium carbonate:zirconium carbonate being 59:22.3:15.1:3.6 by weight.

15. A slurry according to claim 5, further comprising less than 10 wt. % zirconia powder.

16. A slurry according to claim 15, said zirconia powder having a mean particle size of 0.001–5 $\mu$m.

17. A slurry according to claim 5 further comprising less than 1 wt. % wetting agent.

18. A slurry according to claim 5, wherein 100 grams of said slurry retains at least 95% of its initial specific gravity for at least 24 hours under ambient conditions of 1 atm and 22° C. in an open beaker.

19. A slurry according to claim 5, wherein 100 grams of said slurry retains at least 95% of its initial specific gravity for at least 48 hours under ambient conditions of 1 atm and 22° C. in an open beaker.

20. A slurry according to claim 5, said suspended solids remaining in suspension for at least 2 hours without requiring mixing to re-suspend settled solids.

21. A slurry according to claim 5, said suspended solids remaining in suspension for at least 24 hours without requiring mixing to re-suspend settled solids.

22. A mercury vapor discharge lamp comprising a light-transmissive glass envelope, an electrode disposed within said glass envelope to provide a discharge, a phosphor layer coated adjacent an inner surface of said envelope, a fill gas of mercury and an inert gas sealed inside said envelope, and a rare earth oxide layer substantially uniformly disposed over a surface of said electrode, said oxide layer being formed from an emission mix slurry, said slurry comprising 20–50 wt. % suspension medium, and greater than 50 wt. % and not more than 80 wt. % carbonate powder as suspended solids, said suspension medium being selected from the group consisting of (a) organic materials having a vapor pressure of less than 0.1 mm Hg at 20° C., and (b) water.

23. A lamp according to claim 22, comprising 60–80 wt. % carbonate powder as suspended solids.

* * * * *